United States Patent [19]

York

[11] 4,377,465

[45] Mar. 22, 1983

[54] OIL SHALE RETORTING METHOD AND APPARATUS

[75] Inventor: Earl D. York, Englewood, Colo.

[73] Assignee: Standard Oil Company (Indiana), Chicago, Ill.

[21] Appl. No.: 208,164

[22] Filed: Nov. 19, 1980

[51] Int. Cl.[3] ..... C10G 1/00

[52] U.S. Cl. ..... 208/11 R; 208/8 R; 201/12; 201/31

[58] Field of Search ..... 208/11 A, 8 R; 201/12, 201/31, 32, 33

[56] References Cited

U.S. PATENT DOCUMENTS

| | | | |
|---|---|---|---|
| 2,844,521 | 7/1958 | Jahnig | 201/12 |
| 3,655,518 | 4/1972 | Schmalfeld et al. | 208/11 R X |
| 4,105,502 | 8/1978 | Choi | 208/11 R X |

FOREIGN PATENT DOCUMENTS

| | | | |
|---|---|---|---|
| 672157 | 5/1952 | United Kingdom | 201/12 |

*Primary Examiner*—Delbert E. Gantz
*Assistant Examiner*—Glenn Caldarola
*Attorney, Agent, or Firm*—Thomas W. Tolpin; William T. McClain; William H. Magidson

[57] ABSTRACT

Disclosed is an improved method and apparatus for the retorting of oil shale and the formation of spent oil shale having improved cementation properties. The improved method comprises passing feed comprising oil shale to a contacting zone wherein the feed oil shale is contacted with heat transfer medium to heat said shale to retorting temperature. The feed oil shale is substantially retorted to form fluid material having heating value and forming partially spent oil shale containing carbonaceous material. At least a portion of the partially spent oil shale is passed to a combustion zone wherein the partially spent oil shale is contacted with oxidizing gas comprising oxygen and steam to substantially combust carbonaceous material forming spent oil shale having improved cementation properties.

12 Claims, 1 Drawing Figure

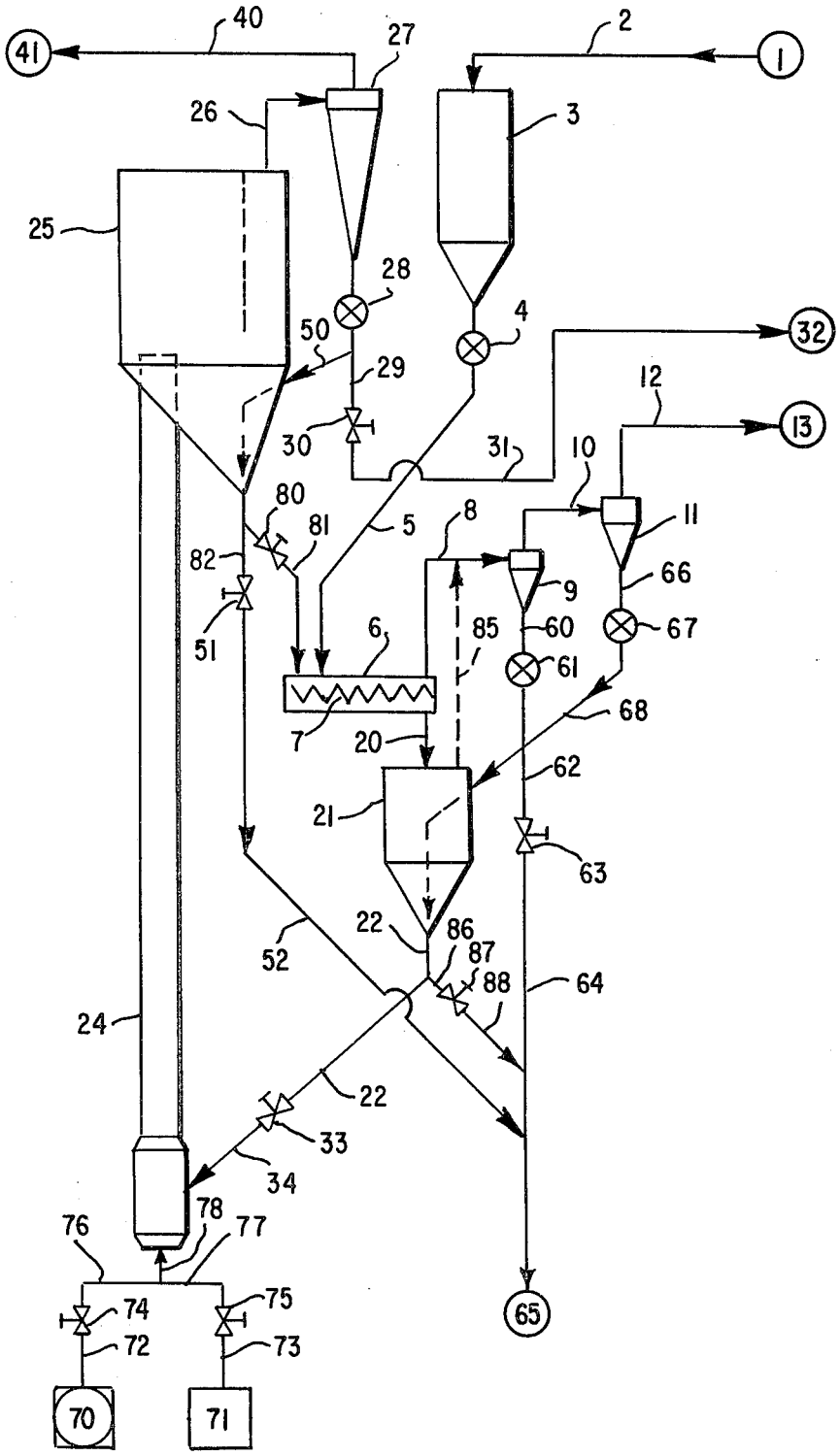
40
41
27
2
1
26
3
25
28
4
50
32
29
12
13
30
31
10
80
11
81
5
8
82
9
66
51
6
85
60
67
61
7
68
20
62
21
63
22
86
52
87
64
88
24
22
33
34
76
78
77
74
75
65
72
73
70
71

OIL SHALE RETORTING METHOD AND APPARATUS

BACKGROUND

This invention relates to the retorting of oil shale. More specifically, this invention relates to an improved process and apparatus for the retorting of oil shale, the production of spent oil shale having improved cementation properties.

The term "oil shale" refers to sedimentary deposits containing organic materials which can be converted to shale oil. Oil shale can be found in various places throughout the world, especially in the United States in Colorado, Utah, and Wyoming. Some especially important deposits can be found in the Green River formation in the Piceance Basin, Garfield and Rio Blanco countries, in Northwestern Colorado.

Oil shale contains organic material called kerogen which is a solid carbonaceous material from which shale oil can be produced. Commonly oil shale deposits have variable richness of kerogen content, the oil shale generally being stratified in horizontal layers. Upon heating oil shale to a sufficient temperature, kerogen is decomposed and liquids and gases are formed. These fluids contain heating values and comprise shale oil, carbon monoxide, carbon dioxide, hydrogen, light hydrocarbon gases, water, hydrogen sulfide, and others. Oil shale can be retorted to form a hydrocarbon liquid either by in situ or surface retorting. In surface retorting, oil shale is mined from the ground, brought to the surface, crushed, and placed in vessels where it is contacted with hot heat transfer medium, such as hot shale or gases, for heat transfer. The resulting high temperatures cause shale oil to be freed from the oil shale forming a partially spent oil shale comprising inorganic material and carbonaceous material commonly referred to as coke. The coke may be deposited on the surface of the shale particles and also within the shale particles. The carbonaceous material can be burned by contact with oxygen at oxidation temperatures to recover heat and to form a spent oil shale relatively free of carbon. Spend retorted oil shale which has been depleted in carbonaceous material is removed from the reactor and discarded. Some well-known methods of surface retorting are the Tosco, Lurgi-Ruhrgas, and Paraho processes and fluid bed retorting, among others.

In the Tosco process ceramic balls heated primarily by combustion of retort off-gas, contact shale in a horizontal rotary kiln. Kerogen is broken down and emanates from the kiln as gases which are fractionated to yield liquid products plus off-gas which is in turn combusted to heat the ceramic balls. Spent shale is separated from the ceramic balls by screening, cooled and sent to disposal. The ceramic balls are recycled to a heater and then to the rotary kiln.

In the Lurgi type retorting raw fresh crushed shale is fed into a mixer wherein it is contacted with hot spent or partially spent shale. The combined oil shales are then fed into a zone for additional residence time. Shale oil which has been retorted from the oil shale is separated from the shale. The oil is recovered and the spent and partially spent shale is passed to a zone wherein carbon is burned off the shale. This can be done by introducing air or air and fuel to the zone to combust the carbon. A preferred method is to pass the spent and partially spent shale, and air or air and fuel upwardly through a vertical elongated zone such as a lift pipe. A majority of the spent shale is then removed from the flue gas from said zone by gravity, cyclones, and electrostatic precipitators. Spent shale from the separators and collecting bin can be used for the manufacture of solid masses. Another portion of the spent shale is fed to the mixer to transfer heat to fresh oil shale. This process is more fully described in U.S. Pat. No. 3,655,518 which is incorporated by reference and made a part hereof.

In the Paraho process fresh shale is fed to the top of a vertical shaft kiln, contacted with hot gases produced by either in situ combustion of coke on spent shale or externally heated recycle gas. Kerogen breakdown products are withdrawn from the kiln by vapor and mist collecting tubes near the top of the kiln. Spent shale is removed from the bottom of the kiln by a grate system. Vapors and mist leaving the kiln are separated to yield oil product and combustible gas for use.

In fluid bed retorting, crushed shale is contacted with hot spent shale and/or hot gases in a fluid bed. The fluid bed may be an elongated vertical zone wherein solids are introduced at or near the bottom and maintained in a fluidized state by high gas velocity. High temperatures cause oil shale and partially spent oil shale to be formed. Solids are separated from liquid and gaseous products, and partially spent oil shale containing carbonaceous material is passed to a fluidized oxidation zone to burn the carbonaceous material and form spent oil shale relatively free of carbon.

Knepper et al., U.S. Pat. No. 4,120,355 and Watson et al., U.S. Pat. No. 4,131,416, teach the introduction of aqueous slurries of spent oil shale from surface retorting into spent subterranean in situ oil shale retorts to form mechanically strong structures. These structures can prevent surface subsidence above the retort, and prevent leaching of chemicals from the mass of rubblized spent shale underground.

O'Neal, U.S. Pat. No. 3,459,003 teaches the use of slurries of spent shale from surface retorting and water, and in some cases cement, for forming of a competent mass having structural strength underground.

Fondriest, U.S.S.E.N.O. 803,730, filed June 6, 1977, teaches the use of concrete, sometimes containing spent oil shale from surface retorting, to fill underground voids formed from the mining of oil shale or coal. The concrete forms load bearing pillars so that support pillars of hydrocarbonaceous material can be removed.

In order for a slurry of water and spent oil shale from surface retorting to be suitable to form a mechanically strong and environmentally acceptable structure, the spent oil shale preferably has certain properties. The spent shale should contain less than about 0.5 weight percent carbon, still more preferably less than about 0.2 weight percent carbon, so that the spent shale can be suitably wet by water. The particle size of spent shale is of some importance and preferably the spent shale should be smaller than about 150 mesh, more preferably smaller than about 200 mesh. Some retorts such as the Fuschun and Pumpherston retorts have contacted oil shale with air and steam. However, this contacting is to gasify the carbon and form combustion gases rather than to effect a substantially complete oxidation of the carbon and the formation of essentially carbon free spent shale. These two processes are described in *European Shale-Treating Practice,* William W. Odell and E. L. Baldeschwieler, Bureau of Mines Information Circular 7348.

It is an object of this invention to provide an improved method and apparatus for the retorting of oil shale.

It is an object of this invention to provide a method and apparatus for manufacturing spent oil shale from surface retorting which has improved cementation properties.

It is an object of this invention to provide a retorting process which substantially converts inorganic carbonates to oxides and eliminates the need for a separate calcination step.

SUMMARY OF THE INVENTION

The objects of this invention can be attained by an improved apparatus and method for the retorting of oil shale comprising passing feed comprising oil shale to a contacting zone wherein the feel oil shale is contacted with heat transfer medium to heat said shale to retorting temperature. The feed oil shale is substantially retorted to form fluid material having heating value and forming partially spent oil shale comprising inorganic and carbonaceous material. Material comprising at least a portion of the partially spent oil shale is passed to a combustion zone wherein the partially spent oil shale is contacted with oxidizing gas comprising oxygen and steam to substantially combust and oxidize carbonaceous material forming spent oil shale having improved cementation properties.

In one embodiment, the improved method comprises passing feed comprising crushed raw oil shale into a contacting zone wherein the feed oil shale is contacted with a heat transfer medium, preferably comprising spent oil shale to heat said feed oil shale to retorting temperature in excess of about 400° C., preferably about 450° C. to about 550° C. Unduly high temperatures result in cracking and coking, and cause lower liquid yields. The feed oil shale is substantially retorted to form fluid material comprising shale oil and forming partially spent oil shale containing coke. At least a portion of the partially spent oil shale is passed to a combustion zone wherein the partially spent oil shale is contacted with oxidizing gas comprising from about 5 to about 25 mol percent oxygen and about 1 to about 75 mol percent steam at a temperature in excess of about 550° C., preferably from about 650° C. to 800° C. to substantially combust the coke and form spent oil shale having improved cementation properties as a consequence of the steam present. Unduly high temperatures can cause sintering and agglomeration of the shale.

Feed oil shale is generally crushed to suitable size of contact with a heat exchange medium. It is generally desirable to crush the shale to a size sufficient to insure easy handling and rapid heat exchange. Some processes provide that the feed oil shale have a particle size less than about a one half of an inch in diameter while fluidized bed retorting may require somewhat smaller particle size.

The feed oil shale can have a wide range of kerogen content, often ranging from about 10 to about 90 gallons per ton by the Fischer Assay Technique. However, for surface retorting it is generally preferable to retort richer shales, such as those containing at least about 20 gallons per ton or higher.

The contacting zone can have a wide variety of configurations so long as the feed oil shale and the heat transfer medium undergo thorough mixing. Some of the preferred configurations for the contact zone comprise fluid beds, transport reactors and mechanical mixing devices such as screw mixers and rotating calciners.

The heat transfer medium generally comprises hot gases, hot solids, or mixtures thereof, which are essentially inert in the retorting environment. The heat transfer medium should not substantially oxidize hydrocarbons or detrimentally react with or affect the oil shale, products formed, or equipment materials at the temperatures and pressures of the environment.

The heat transfer medium may preferably comprise hot spent oil shale. Both spent oil shale and feed oil shale may cause slight abrasion or erosion which can be controlled by selection of equipment materials. The amount of heat transfer medium used or recycled can be varied to control heat balance which will be affected by oil shale kerogen content, amount and type of carbonates, amount of water in the feed, and others.

The retorting takes place in the contacting zone or in a zone in conjunction with the contacting zone which provides suitable reaction time to effect substantial retorting. It is desirable to remove as much hydrocarbon from the rock as is economically feasible. Generally at least 80 percent of Fisher Assay is recovered and in some cases recovery in excess of 100 percent is possible. Even though the feed shale is substantially retorted, the partially spent shale from the retorting process will contain carbonaceous material such as coke. Coke is a carbonaceous material having a low hydrogen to carbon ratio and low solubility in most hydrocarbon solvents. After retorting it is very common for the partially spent shale to have coke on or in the inorganic matrix of the shale. Commonly partially spent shale will contain about 1 to about 10 weight percent carbon. The amount of carbon on partially spent oil shale is a function of shale type and richness, and retorting conditions such as temperature, contact time and heat transfer efficiency.

Retorting of oil shale can be conducted to provide a variety of fluid products, both gases and liquids. The mixture of gases and liquids can be varied somewhat by controlling or modifying reaction parameters especially temperature. Some of the products which are formed are shale oil; light hydrocarbon gases such as methane, ethane, ethene, propane, propene and the like; hydrogen; carbon dioxide; carbon monoxide; hydrogen sulfide; ammonia; and others. It is generally desirable to maximize liquid yield and minimize the amount of lower valued product gases formed.

In order to more fully recover the energy from the oil shale, the partially spent oil shale is contacted with an oxidizing gas comprising about 5 to about 25 mol percent oxygen and about 1 to about 75 mol percent steam in an oxidation zone. Preferably the oxidizing gas comprises about 10 to about 20 mol percent oxygen and about 25 to about 50 mol percent steam. The reaction can be conducted at a temperature in excess of about 550° C., preferably about 650° C. to about 800° C., for a time sufficient to substantially oxidize the carbonaceous material and form spent oil shale having improved cementation properties. Oxidation conditions should be selected to burn substantially all of the carbon from the shale, preferably at least about 95 percent carbon removal, and substantially decompose most of the carbonates, preferably at least about 50 percent carbonate conversion.

In addition to steam, the oxidation gas can comprise air, oxygen enriched air, and other gases. In some cases, the oxidation gas can contain gases for disposal such as ammonia or hydrogen sulfide from a retort water stripper.

The oxidation zone can have numerous shapes and configurations. The most important consideration is to achieve good contacting with oxygen and achieve reasonable temperature control. One desirable type of combustion zone comprises an upflow elongated transport reactor wherein partially spent oil shale is introduced at or near the bottom, and fluidized and passed upwardly by high velocity gases. The gas velocity should be sufficient to lift the particles on the desired paths, generally at a gas rate of at least about 25 feet/-second. However, combustion in some fluid beds can be conducted at substantially lower gas velocities. The oxidation zone should be able to withstand high temperatures, and may preferably be refractory lined. Other parts of this process may also have proper metallurgy to withstand operating temperatures. Carbon on the particles is combusted as the particles pass upwardly. The temperature of the gases and solids rise substantially as they are passed upwardly. The combustion zone can be operated at temperatures in excess of about 650° C., preferably in the range of about 700° C. to about 800° C. At temperatures too low the oxidation of the carbon proceeds at too low a rate and carbonate decomposition is lower. At temperatures higher than 800° can cause sintering of the shale and also require special materials for the high temperature. At high temperatures, exothermic reactions involving silica could result in uncontrolled temperature increases.

After the partially spent shale is oxidized in the combustion zone, spent oil shale is formed having an extremely low carbon content. Spent oil shale commonly has a carbon content less than about 0.5 weight percent, preferably less than 0.2 weight percent. If desired, at least a portion of the spent oil shale from the combustion zone can be passed to a cooling zone. Generally, about 10 to about 100 weight percent, preferably about 30 to about 100 weight percent of the spent shale from the combustion zone can be passed to a cooling zone.

Spent oil shale can be removed from the process downstream of the cooling zone for disposal; however, it is generally preferable to pass essentially all of the spent oil shale from the cooling zone to the contacting zone. The cooling zone reduces the temperature of the spent shale from the combustion zone by about 1° C. to about 100° C. Preferably, the cooling zone reduces the temperature of the spent shale by about 10° C. to about 50° C. The cooled shale which is still quite hot is passed to the contacting zone where it transfers heat to feed oil shale and heats the shale towards its retorting temperature.

Recycle rates depend on richness, temperature after cooling, and inorganic matrix composition but typically range from about 3–12 times the fresh feed rate, preferably about 4–8 times the fresh feed rate.

Slurries which form solid strong structures can be provided by combining spent shale with liquid comprising water. The slurries comprise one part spent oil shale and about 50 to about 300, preferably about 75 to about 150, weight percent water based on spent oil shale. Other additives can be added to control the rate of solidification, water leakage, and other properties.

THE DRAWING

The attached drawing is a schematic representation of one of the embodiments of this invention.

Raw shale 1 crushed to a particle size of less than about a half inch in diameter is passed through line 2 to feed hopper 3. The feed hopper is a large container for storing a suitable amount of feed for the process. The crushed feed shale from feed hopper 3 is passed by gravity through valve 4 through line 5 where it is passed into one end of a mixing zone 6. This mixing zone contains a screw mixer 7 which is characteristic of a Lurgi-type process.

Hot spent shale from collecting bin 25 is passed through valve 80, through line 81, to mixing zone 6 where it is thoroughly mixed with raw feed shale. Much of the rotorting takes place within mixing zone 6. However, because of relatively short residence times, the mixture of hot spent shale and partially retorted shale or feed shale passes from the end of the contacting zone through line 20 into surge bin 21 which provides additional time to complete retorting. Because of the relatively high temperatures involved, retorting at about 400° C. to about 550° C., the oil formed by retorting is primarily in the vapor state. The oil in the gaseous state and light hydrocarbons, hydrogen sulfide, ammonia and various other off-gases pass through line 8 to cyclone separator 9 for the removal of finely divided dust and spent shale. The product stream passes through line 10 to another cyclone separator 11 for further purification and then on through line 12 to recovery 13. The separated dust or spent shale from cyclone 9 can be passed through line 60, valve 61, line 62, valve 63 and line 64 for disposal 65 or alternatively to surge bin 21. The separated dust or spent shale from cyclone 11 can be passed through line 66, valve 67, and line 68 for recycle back to surge bin 21. Surge bin 21 is also provided with line 85 to remove additional gaseous products back to line 8 for purification and product recovery. The surge bin 21 contains a mixture of partially spent shale from retorting and also finely divided spent shale which was used as a heat transfer medium. Some of this mixture from the bottom of surge bin 21 can be removed through line 86, through valve 87 and line 88 and passed to disposal 65. However, the mixture from surge bin 21 containing about 1 to about 5 weight percent organic carbon generally passes through line 22 and valve 33 and line 34 to near the base of an elongated vertical lift pipe combustion zone 24. Air 70 from a compressor is passed through line 72, 71 through valve 74 and line 76 for blending with steam 71 which is passed through line 73, valve 75 and line 77 where it is combined with the air. Air for combustion is generally preheated to over 300° C. The air and steam are combined in line 78 and passed into the base of the lift heater. The velocity of this mixture of air and steam is sufficient to pass the solids from line 34 upwardly through the lift pipe and substantially effect combustion of the carbonaceous material on or in the inorganic matrix. A mixture of up to 50 mol percent steam in air, preferably 15 to 35 mol percent steam in air is used to oxidize the carbon from the spent shale and decrease carbonate content. The mixture of combustion gases and spent shale is passed into a collecting bin 25 where a portion of the spent shale is collected for recirculation back to the mixing zone 6. The collecting bin also provides line 82, valve 51 and line 52 to provide for the passage of spent shale to disposal 65. Gases from the lift pipe are passed through collecting bin 25 through line 26 to cyclone 27 for separation of finely divided spent shale from gases. Purified gases are passed through line 40 to an off-gas clean up process and heat recovery 41. Commonly the off-gas clean up will encompass some heat exchange and electrostatic precipitators to remove very finely divided spent shale. Dust from cyclone 27 is passed through valve 28 either for recycle to mixing zone 6 through line 50 or through line 29, valve 30 and line 31 for disposal 32. It is preferable to remove most spent shale from the process because this spent shale will have undergone the thorough oxidation in lift heater 24 and will be most suitable for cementation purposes. Introduction of steam 71 at the base of lift heater 24 also provides for humidification of the off-gas stream passing through line 40 which will aid in the removal of very finely divided dust by electrostatic precipitators.

We claim:

1. An improved method for processing oil shale, comprising the steps of:

retorting raw oil shale by contacting said raw oil shale in a retort with a solid heat transfer medium consisting essentially of spent oil shale at a sufficient temperature to liberate hydrocarbons including shale oil from said raw oil shale leaving retorted oil shale containing carbonaceous material;

passing said retorted oil shale containing carbonaceous material to a generally vertical lift pipe defining a combustion zone spaced away from and located outside of said retort;

injecting an oxidizing gas comprising oxygen and steam into said vertical lift pipe to substantially combust said carbonaceous material on said retorted shale forming spent oil shale having improved cementation properties, said oxidizing gas being injected into said vertical lift pipe at a sufficient velocity to lift said spent oil shale upwardly through said lift pipe into a collecting bin;

feeding a portion of said spent oil shale from said collecting bin to said retort for use as said solid heat transfer medium;

feeding said raw oil shale only to said retort removing another portion of said spent oil shale from said collecting bin; and forming a cementatious slurry by adding a sufficient amount of water to said removed spent oil shale.

2. The method of claim 1 wherein:

combustion gases are emitted during said combustion;

said combustion gases are dedusted in an electrostatic precipitator; and said steam humidifies said combustion gases to enhance said dedusting in said electrostatic precipitator.

3. The method of claim 1 wherein retorting is commenced in a screw mixer and is substantially completed in a surge bin.

4. The method of claim 1 wherein: said oxidizing gas comprises from about 5 mol % to about 25 mol % oxygen and from about 1 mol % to about 75 mol % steam; said velocity of said oxidizing gas is at least 25 ft/sec; and said carbonaceous material is combusted in said lift pipe at a temperature greater than 550° C. to form said spent shale having improved cementation properties.

5. The method of claim 4 wherein: said oxidizing gas comprises from about 10 mol % to about 20 mol % oxygen and about 25 mol % to about 50 mol % steam and said carbonaceous material is combusted in said lift pipe at a temperature ranging from 650° C. to 800° C.

6. The method of claim 1 wherein: air and steam are separately injected into said lift pipe to form said oxidizing gas and said air is preheated to over 300° C. before being injected into said lift pipe.

7. The method of claim 1 wherein said oxidizing gas consists essentially of air diluted with 15 mol % to 35 mol % steam.

8. The method of claim 1 wherein said oxidizing gas consists essentially of air diluted with up to 50 mol % steam.

9. The method of claim 1 wherein said cementatious slurry is formed by mixing from 50% to 300% by weight water with said spent shale having improved cementation properties.

10. The method of claim 9 wherein said cementatious slurry is formed by mixing from 75% to 100% by weight water with said spent oil shale having improved cementation properties.

11. An improved apparatus for processing oil shale, comprising:

retort means defining a contacting zone, said retort means including a screw mixer and a surge bin;

raw feed means for feeding raw oil shale to said screw mixer;

spent shale feed means for feeding a solid heat transfer medium consisting essentially of spent oil shale into said screw mixer at a sufficient temperature to liberate hydrocarbons from said raw oil shale;

combustion means defining a combustion zone spaced away from said screw mixer and said surge bin, said combustion means including a substantially vertical lift pipe and an overhead collecting bin;

combustion feed means for feeding retorted oil shale containing carbonaceous material from said surge bin to said lift pipe;

air injection means for injecting air into said lift pipe;

steam injection means for injecting steam into said lift pipe; and valve means for controlling the amount and velocity of said air and said steam being injected into said lift pipe to substantially combust said carbonaceous material leaving spent oil shale having improved cementation properties and to lift said spent shale upwardly into said collecting bin.

12. An improved method for processing oil shale, comprising the steps of:

retorting crushed raw oil shale into a retort defining a contacting zone with a solid heat transfer medium comprising spent oil shale at a sufficient temperature to liberate hydrocarbons including shale oil from said raw oil shale leaving retorted oil shale comprising inorganic material and carbonaceous coke;

passing said retorted oil shale to a generally vertical lift pipe defining a fluid bed combustion zone spaced away from and outside of said retort;

separately injecting steam and air preheated to at least 300° C. into said vertical lift pipe to substantially combust said carbonaceous coke and emit combustion gases leaving spent oil shale having improved cementation properties. said steam humidifying said combustion gases for enhanced downstream dedusting, and said steam and preheated air being separately injected into said vertical lift pipe at a sufficient velocity to lift said shale upwardly through said lift pipe into a collecting bin;

feeding a portion of said spent oil shale from said collecting bin to said retort for use as said solid heat transfer medium;

said retorting is commenced in a screw mixer and substantially completed in a surge bin; and another portion of said spent oil shale having improved cementation properties is removed from said collecting bin and mixed with 75% to 150% by weight water to form a cementatious slurry.

* * * * *

UNITED STATES PATENT OFFICE

CERTIFICATE OF CORRECTION

Patent No. 4,377,465 Dated March 22, 1983

Inventor(s) Earl D. York et al.

It is certified that error appears in the above-identified patent and that said Letters Patent are hereby corrected as shown below:

| Column | Line | |
|---|---|---|
| 2 | 42 | "U.S.S.E.N.O." should be --U.S.S.N.-- |

Signed and Sealed this

Twenty-sixth Day of July 1983.

[SEAL]

Attest:

GERALD J. MOSSINGHOFF

Attesting Officer

Commissioner of Patents and Trademarks